United States Patent [19]

Wendt et al.

[11] Patent Number: 4,662,664

[45] Date of Patent: May 5, 1987

[54] LOCK FOR PAPER TOWEL DISPENSER CABINET

[75] Inventors: David W. Wendt, Monona; Daniel R. Bullis, Jr., Madison; Alan F. Kemp, Janesville, all of Wis.; Gregory R. Suzda, Colorado Springs, Colo.

[73] Assignee: Mosinee Paper Corporation, Mosinee, Wis.

[21] Appl. No.: 752,998

[22] Filed: Jul. 8, 1985

[51] Int. Cl.[4] ..... E05C 13/06

[52] U.S. Cl. ..... 292/19; 292/87; 292/DIG. 38; 70/63

[58] Field of Search ..... 292/170, 37, 19, 27, 292/20, 83, 85, 124, DIG. 38, 87, 80; 70/120, 162, 158, 63, 344, 403, 123, 67-76, 95-97

[56] References Cited

U.S. PATENT DOCUMENTS

| | | | |
|---|---|---|---|
| 1,836,209 | 12/1931 | Viehweger | 292/37 |
| 2,506,846 | 5/1950 | Teasdale | 292/19 |
| 3,659,442 | 5/1972 | Cellini et al. | 292/19 |
| 3,671,065 | 6/1972 | Bingham | 292/DIG. 38 |
| 3,907,346 | 9/1975 | van Klompenburg | 292/DIG. 38 |
| 4,113,217 | 9/1978 | O'Connell | 292/87 |
| 4,139,249 | 2/1979 | Hillman | 292/87 |
| 4,186,952 | 2/1980 | Glass | 292/DIG. 38 |
| 4,390,198 | 6/1983 | Selinko | 292/DIG. 38 |
| 4,500,120 | 2/1985 | Ridgewell et al. | 292/19 |
| 4,544,191 | 10/1985 | Nakama | 292/DIG. 38 |

*Primary Examiner*—Gary L. Smith
*Assistant Examiner*—Vinh Luong

[57] ABSTRACT

A lock (11) for a paper towel dispensing cabinet (10) including a latch (20) and bushing (21) arranged with the bushing extending through the door (14) of the cabinet and the latch secured to the door of the cabinet. The latch includes ramped sidewalls (24) which engage wedge structures (58) on the door and resilient retainer arms (27) which engage stops (60) on the door, to thereby hold the latch in position. The latch also includes a pair of resilient catch arms (30) that engage apertures (61) in the back of the cabinet to hold the door in a locked position. A key (22) is provided to release the catch arms so that the door of the cabinet can be opened. The latch, bushing and key can each be made of molded plastic material.

5 Claims, 12 Drawing Figures

LOCK FOR PAPER TOWEL DISPENSER CABINET

TECHNICAL FIELD

This invention relates to locks suitable for holding a towel dispenser cabinet door shut.

BACKGROUND OF THE INVENTION

Paper towel dispenser cabinets usually comprise a back and a door hingedly connected to the back. Because the cabinet houses articles such as paper toweling and moving parts, it is desirable to inhibit unauthorized access to the interior of the cabinet. This is accomplished by providing the door with a lock to lock it shut against the back.

The components of the prior art locks are usually subassembled and then riveted to the door, with a catch or aperture being provided in the back to cooperate with the lock to hold the door shut. These locks usually have several parts and at least some of the parts are metal. The several parts of these locks, the required subassembly operations and the fact that some of the parts are metal makes the provision of a lockable door in prior art cabinets difficult and therefore expensive.

SUMMARY OF THE INVENTION

In an improved lock of the present invention, a molded plastic latch which has at least one ramped sidewall and one resilient retainer arm is mounted to a cabinet door by sliding the ramped sidewall into a wedge structure on the door until the retainer arm locks behind a shoulder stop also on the door. The latch also has at least one catch arm which is spaced a distance apart from the door and has a side surface with a ramped end which defines a rearwardly facing shoulder and a cam surface. The door has a hole which is substantially aligned with the cam surface and in which a molded plastic latch bushing is rotatably mounted. The latch bushing has a shoulder and is disposed between the door and the latch so that the bushing is captivated in the hole. An axial slot extends through the latch bushing and is in registration with the cam surface in at least one angular orientation of the latch bushing. The back has an aperture to receive the ramped end of each catch arm when the door is shut so that the shoulder of each catch arm locks behind an edge of an aperture to hold the door securely shut against the back. The door is opened by inserting a key into the slot in the latch bushing and into registration with the cam surface, whereby turning the key causes the key to cam on the cam surface and urge the catch arm away from the aperture edge. When the shoulder clears the aperture edge, the door can be opened.

It is an object of the invention to provide an improved lock for paper towel dispenser cabinets.

It is another object of the invention to provide an improved lock for paper towel dispenser cabinets which comprises only two separate pieces.

It is another object of the invention to provide an improved lock which is easily molded from plastic material.

It is yet another object of the invention to provide an improved lock which is assembled to the dispenser cabinet without any subassembly operations.

These and other objects and advantages of the invention will become apparent from the following description.

DESCRIPTION OF THE DRAWINGS

The present invention is described below, as required by 35 U.S.C. §112, in such full detail as to enable those skilled in the art to practice the invention and also to set forth the presently-contemplated best modes for its practice, all by reference to the following drawings in which.

DETAILED DESCRIPTION OF THE PREFERRED EMBODIMENT

Figure 1:
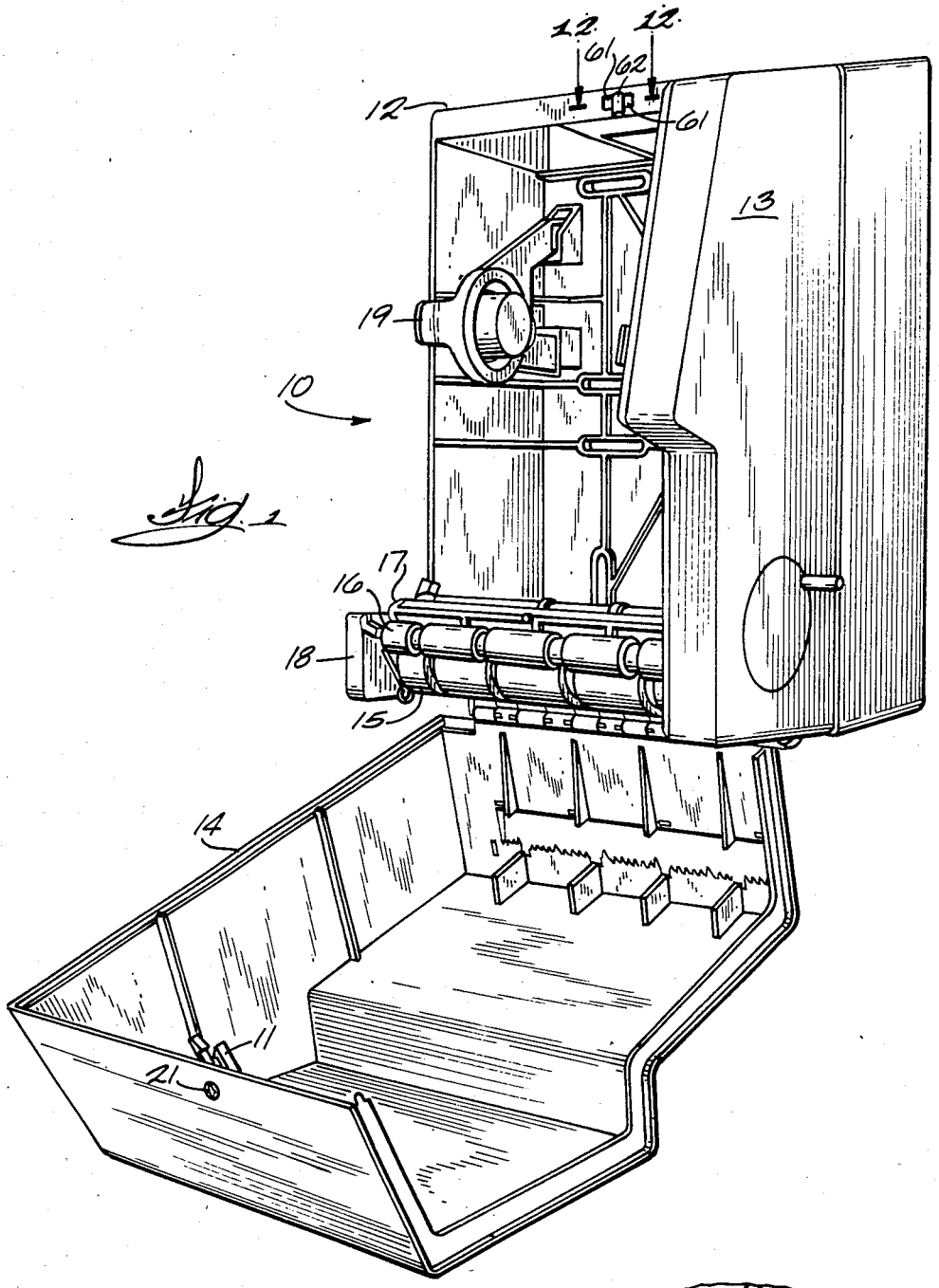
FIG. 1 is a perspective view of a paper towel dispenser cabinet with the door open which includes a lock of the present invention.
Figure 2:
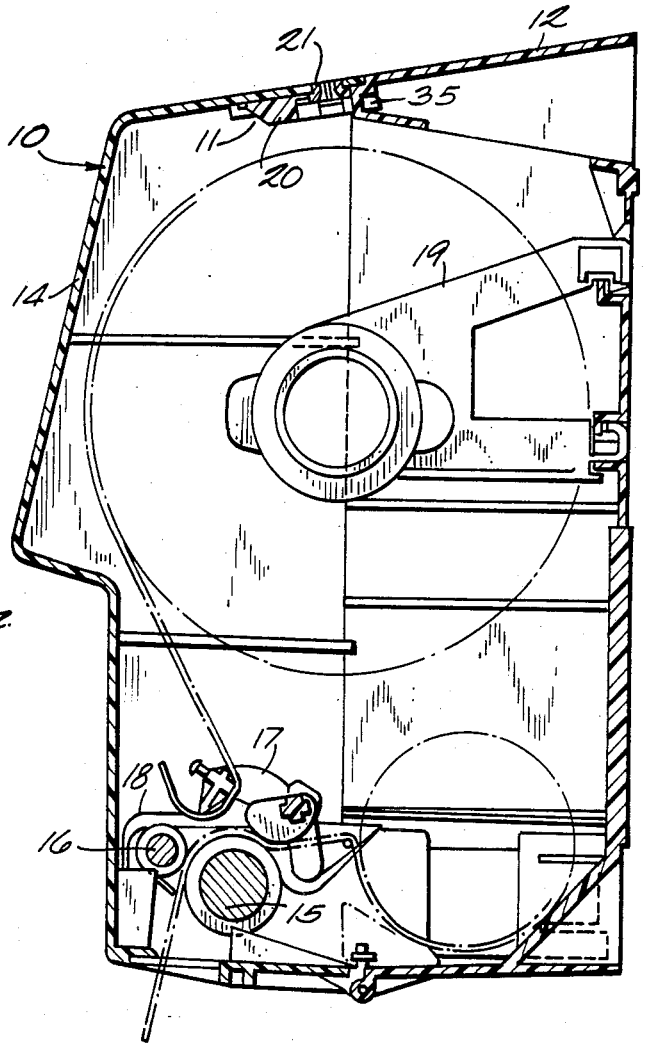
FIG. 2 is a sectional view of the dispenser of FIG. 1 with the door shut.

FIGS. 1 and 2 illustrate a paper towel dispenser cabinet 10 which includes a lock 11 of the present invention. The dispenser cabinet 10 comprises a back 12 to which all of the other components are mounted and which makes up the rear portion of the cabinet, a mechanism module 13 attached to the back to form the forward portion of the right side of the cabinet, and a door 14 hingedly connected to the back. The mechanism module 13 carries the right hand ends of a drive roll 15, an idler roll 16 and a transfer bar 17. A feed roll support arm 18 extends from the back 12 and supports the left hand ends of the drive roll 15, the idler roll 16 and the transfer bar 17. A reserve roll support arm 19 is assembled to the back 12 above the support arm 18. A full description of the cabinet 10 is given in the copending U.S. Pat. application Ser. No. 751,336, entitled Modular Paper Towel Dispenser filed on July 1, 1985 and assigned to the same assignee, the disclosure of which is hereby incorporated by reference.

However, the lock of the present invention can be incorporated in many different types of towel or tissue dispenser cabinets, and the cabinet 10 is exemplary only.

Figure 3:
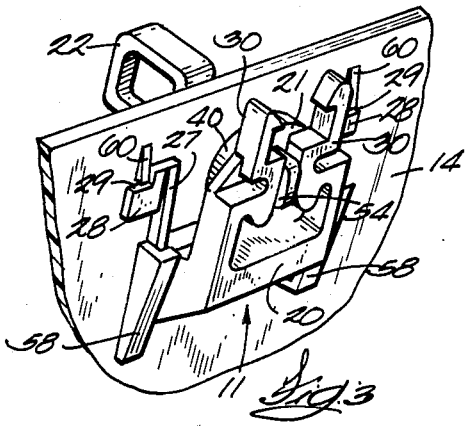
FIG. 3 is a perspective detail view of the lock assembled to the door of the cabinet of FIG. 1.

The lock 11 holds the door shut against the back 12 and the mechanism module 13 and is shown assembled to the door 14 in FIG. 3. The principal elements of the lock include a latch 20 and a latch bushing 21. A key 22 is also provided which is fitted to the lock. The latch 20, bushing 21 and key 22 are all molded of a suitable plastic material.

Figure 6:
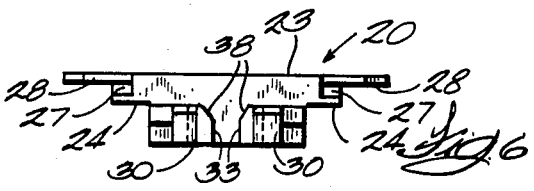
FIG. 6 is a rear plan view of the latch of FIG. 4.
Figure 4:
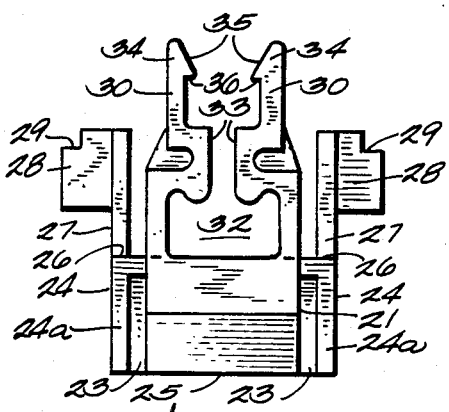
FIG. 4 is a bottom plan view of a latch for the lock of FIG. 3.
Figure 5:
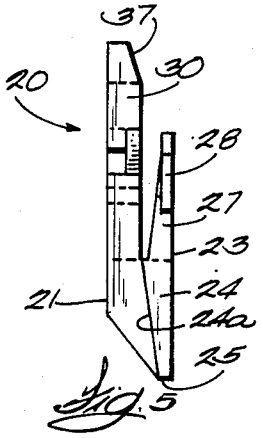
FIG. 5 is a side plan view of the latch of FIG. 4.

Referring to FIGS. 4, 5 and 6, the latch 20 includes a base 23, illustrated in the exemplary embodiment as rectangular in shape. A pair of spaced ramped sidewalls 24 extend upwardly from the base 23, there being a sidewall along each side margin of the base 23. Each ramped sidewall 24 includes a surface 24*a* remote from the base that slopes downwardly towards trailing edge 25 of the base. A pair of spaced resilient retainer arms 27 project from leading edge 26 of the base 23. There is a transversely-extending tab 28 along the end portion of each arm 27 remote from the base, each tab including a notch 29. A pair of catch arms 30, which are longer than the retainer arms, also project from the leading edge of the base 23, the arms being integral with a raised platform 21 formed as part of the base. The catch arms 30 are spaced from each other and resilient toward and away from each other, with a rectangular space 32 between them. A cam surface 33 is defined along an intermediate section of the interior surface of each catch arm 30, arranged so that the cam surface of one arm faces the cam surface of the other arm 30. The free end portion 34 of each catch arm remote from the base 23 includes a ramped surface 35 which defines a rearwardly facing shoulder 36 near the free end of each arm. The free end portions 34 of each catch arm have a beveled top surface 37, best illustrated in FIG. 5. Also, each cam surface has a beveled top surface 38, illustrated in FIG. 6.

Figure 7:
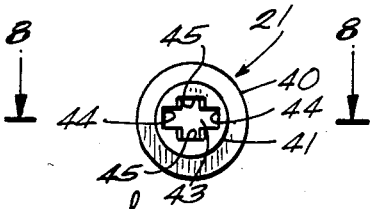
FIG. 7 is a top plan view of a latch bushing for the lock of FIG. 3.
Figure 8:
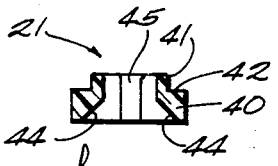
FIG. 8 is a sectional view taken along the plane of the line 8—8 of FIG. 7.

FIGS. 7 and 8 show the latch bushing 21 by itself, which includes a spacer portion 40 and a shank 41 arranged axially next to each other. The spacer portion 40 and shank 41 are preferably circular cylindrical in cross-sectional shape as illustrated, but they each can be of any other selected cross-sectional shape. Spacer portion 40 is to be larger than the shank 41 transversely of the bushing 21 to define a shoulder 42. A rectangular slot 43 extends through the latch bushing 21 and has end walls 44 which diverge from one another or angle outwardly in the spacer portion 40. A pair of opposed recesses 45 are defined in the intermediate portions of the side walls of the rectangular slot 43 and extend all the way through the bushing 21.

Figure 9:
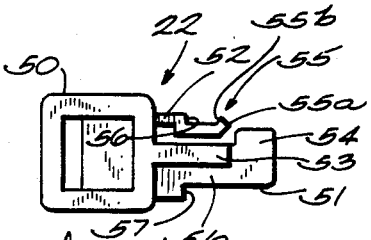
FIG. 9 is a side plan view of a key for the lock of FIG. 3.
Figure 10:
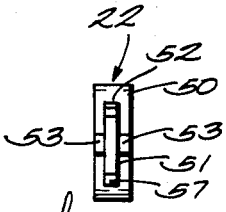
FIG. 10 is a front plan view of the key of FIG. 9.

The key 22, see FIGS. 9 and 10, includes a handle 50, a shank 51 and a resilient finger 52. The shank 51 is generally L-shaped and has a central portion 51*a* extending from the handle and a free end portion 54 that is wider transversely of the key than the first portion 51*a*. A longitudinal rib 53 extends along each side of the central portion of the shank, each rib extending from the handle 50 to the end portion 54 of the shank. The resilient finger 52 extends from the handle of the key and terminates slightly short of the end portion 54 of the shank and is to be resilient towards and away from the shank. The free end 55 of the finger 52 has one surface ramped toward the end portion 54 of the shank as at 55*a* and a second surface ramped toward the handle 50 as at 55*b*. The surface of the finger 52 remote from the shank is formed to have a shoulder 56 spaced from the handle 50 and the shank 51 includes a shoulder 57 positioned opposite from the shoulder 56.

Figure 11:
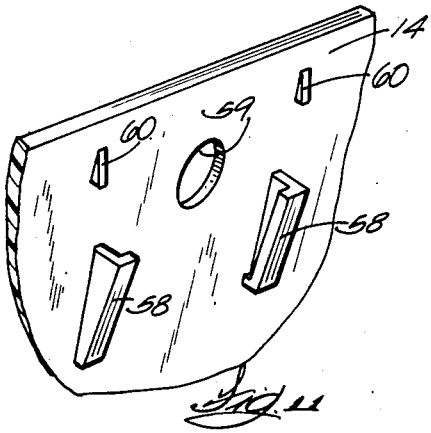
FIG. 11 is a perspective detail view of the portion of the door shown in FIG. 3 without the lock assembled to the door.

Referring to FIGS. 3 and 11, the latch 20 is assembled to the door 14 by sliding the ramped sidewalls 24 into wedge structures 58 which, preferably, are molded into the door 14. Simultaneously, the shank 41 of the bushing 21 is inserted into a hole 59 in the door which is sized to receive the shank 41. The hole 59 is positioned so that it is substantially aligned with the space between the cam surfaces 33 when the latch is assembled to the door. After the bushing 21 is seated in the hole 59, with its shoulder 42 against the inside surface of the door, the latch 20 is slid further rearwardly into the wedge structures 58 and the tabs 28 of the retainer arms 27 ride up onto the ramped upper surfaces of a pair of stops 60, which also are preferably molded into the door 19. As the latch 20 is slid further rearwardly into the wedge structures 58, the wedge structures 58 bear down on the ramped sidewalls 24 to hold the latch 20 snugly in place and captivate the bushing 21 in the hole 59 with the spacer portion 40 between the door and the latch. When the latch 20 is securely within the wedge structures 58, the tabs 28 snap behind the stops 60 to hold the latch in place, with the notch 29 of each tab engaging an end of a stop 60. As thus mounted, the catch arms 30 are free to move toward and away from one another. Also, the bushing 21 can rotate freely in the hole 59, and when the bushing 21 is properly angularly oriented, the slot 44 is aligned with the space between the cam surfaces 33.

Figure 12:
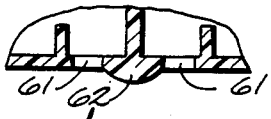
FIG. 12 is a sectional view taken along the plane of the line 12—12 of FIG. 1.

In order to lock the door 14 against the back 12, the door is shut and the catch arms 30 enter a pair of apertures 61 in the back 12 (FIG. 1). The beveled top surfaces 37 of the free end portions 34 of the catch arms help direct the catch arms into the apertures 61 and the ramped surfaces 35 of the free ends of the catch arms cam along the inside edges of the apertures so that they move outwardly. Because the catch arms 30 are resilient, they snap behind the edges of the apertures 61 when the shoulders 36 of the catch arms clear the apertures as shown in FIG. 2. Preferably, this occurs when the door 19 is tight against the back 12 and the mechanism module 13. Also, as best illustrated in FIG. 12, surface 62 between the apertures 61 can be arcuately shaped to help guide the free end portions 34 into the apertures 61.

The key 22 must be used to unlock the door 19. The key is inserted into the slot 43 of the bushing 21 and is rotated until the end of the shank 51 is guided down between the beveled surfaces 38 of the cam surfaces 33 of the catch arms. Inserting the key 22 further causes the ramped free end 55 of the finger 52 to cam into the slot 43 and into the outwardly angled portion of the slot to firm up the fit of the key in the bushing 21 and cause the end 54 of the key to move down between the cam surfaces 33. The downward motion of the key is positively stopped when the shoulders 56 and 57 of the key abut against the top surface of the latch bushing 21. The key is then turned about $\frac{1}{8}$ of a turn to urge the catch arms 30 far enough apart so that the shoulders 36 of the catch arms can clear the apertures 61, and the door is opened.

A lock of the present invention is easily manufactured and assembled. The lock has only two pieces, a latch and a bushing, both of which are molded out of plastic and are therefore inexpensive. Resins suitable for the latch and bushing include appropriate molding grade plastics such as nylon, acetal, urethane, high impact polystyrene and ABS resins. No subassembly operations are required. The two pieces are quickly and easily installed to the cabinet door without requiring any tools. Once assembled to the door, the lock is securely held in place and can be made quite tamper-proof by adding cooperating structure between the key and the latch bushing.

Numerous modifications and variations of the invention will be apparent to those skilled in the art. For example, in some applications, only one catch may suffice. Also, the invention could be embodied in a lock having a latch with only a single ramped sidewall and/or a single resilient retainer arm and a corresponding single wedge structure and/or single shoulder stop, respectively. Of course, the lock could also be assembled to the back with the apertures in the door. Therefore, the invention is not intended to be limited by the scope of the detailed description of the preferred embodiment, but only by the claims which follow, except as otherwise required by law.

We claim:

1. In a lock for a paper towel dispenser cabinet including a back and a door hingedly connected to the back, wherein a key is used to release the lock, the improvement in which:

(a) the lock comprises:

1. a latch including a base, a ramped sidewall extending from the base, a resilient retainer arm and a resilient catch arm projecting from the base, the catch arm including a ramped free end portion, a cam surface, and a shoulder intermediate the ramped free end portion and the cam surface; and 2. a latch bushing comprising a cylindrical shank portion and a spacer portion of different sizes to define a shoulder therebetween, and including a slot which extends axially through the shank and the spacer portion;

(b) a wedge structure on the door for receiving the ramped sidewall of the latch to hold the base in an assembled position against the door, and a stop on the door for engaging the retainer arm to hold the ramped sidewall securely within the wedge structure;

(c) the latch bushing being positioned with the shank extending through a circular hole in the door and the spacer portion disposed between the door and the latch, with the slot in the latch bushing aligned with the cam surface of the catch arm in at least one angular orientation of the latch bushing;

(d) an aperture formed in the back to receive the ramped free end of the catch arm when the door is closed, in which conditions the shoulder of the catch arm engages an interior portion of the back; and (e) the key includes an integral shank for insertion through the slot in the latch bushing into registration with the cam surface of the catch arm, wherein rotation of the key cams the shank on the cam surface to urge the shoulder of the catch arm clear of the aperture in the back so that the door can be opened.

2. A lock according to claim 1, wherein the latch, latch bushing and key are each made of molded plastic material.

3. In a lock for a paper towel dispenser cabinet including a back and a door hingedly connected to the back, wherein a key is used to release the lock, the improvement in which:

(a) the lock comprises:

(1) a latch including a base, a pair of ramped sidewalls arranged with one extending from each side of the base, a pair of spaced resilient retainer arms and a pair of spaced resilient catch arms projecting from a leading edge of the base, each catch arm including a ramped free end portion, a cam surface, and a shoulder intermediate the ramped free end portion and the cam surface; and (2) a latch bushing comprising a cylindrical shank portion and a spacer portion of different sizes to define a shoulder therebetween, and including a slot which extends axially through the shank and the spacer portion;

(b) a pair of wedge structures on the door for receiving the ramped sidewalls of the latch, to hold the base in an assembly position against the door, and a stop on the door for engaging the retainer arms of the latch to hold the ramped sidewalls securely within the wedge structures;

(c) the latch bushing being positioned with the shank extending through a circular hole in the door and the spacer portion disposed between the door and the latch, with the slot in the latch bushing aligned with the cam surfaces of the catch arms in at least one angular orientation of the latch bushing;

(d) an aperture formed in the back to receive the ramped free ends of the catch arms when the door is closed, in which condition the shoulder of each catch arm engages an interior portion of the back; and (e) the key includes an integral shank for insertion through the slot in the latch bushing into registration with the cam surfaces of the catch arms, wherein rotation of the key cams the shank on the cam surfaces to urge the shoulders of the catch arms clear of the aperture in the back so that the door can be opened.

4. A lock according to claim 3, wherein the latch, latch bushing and key are each made of molded plastic material.

5. A lock according to claim 3 or 4, wherein:

the resilient retainer arms each include an integral tab arranged to snap behind the stop means to hold the ramped sidewalls securely within the wedge means.

* * * * *